US005097992A

United States Patent [19]

Shiemann

[11] Patent Number: 5,097,992

[45] Date of Patent: Mar. 24, 1992

[54] SCREW CAP FOR CANISTERS

[76] Inventor: Wolfram Shiemann, Eugen-Nägele-Str. 17, 7140 Ludwigsburg, Fed. Rep. of Germany

[21] Appl. No.: 479,372

[22] Filed: Jan. 12, 1990

[51] Int. Cl.[5] ..... B67D 3/00

[52] U.S. Cl. ..... 222/481.5; 222/478; 222/568

[58] Field of Search ..... 222/478, 481, 481.5, 222/563, 568; 215/307-310

[56] References Cited

U.S. PATENT DOCUMENTS 3,149,758 9/1964 Bush et al. ..... 222/481 X 3,399,811 9/1968 Miller ..... 222/481 X 3,536,107 10/1970 Schreiber ..... 222/481.5 X 4,928,861 5/1990 Schiemann ..... 222/481.5

*Primary Examiner*—Kevin P. Shaver

[57] ABSTRACT

A screw for a plastic canister cap has a through airhole that opens into an annular channel in the base of the cap. The end positions of an external thread on the pouring nozzle and an internal thread on an annular wall of the screw cap are matched to one another and at least two through airholes are provided in the annular channel so that one of the airholes is always at least in the vicinity of the through hole of the pouring nozzle.

6 Claims, 1 Drawing Sheet

SCREW CAP FOR CANISTERS

This invention relates to a screw cap of the kind disclosed in U.S. Pat. No. 4,928,861 of the same inventor, which issued May 29, 1990, and which is incorporated into the present application by reference.

BACKGROUND OF THE INVENTION AND RELEVANT PRIOR ART

Such canisters are mass-produced articles and, owing to their method of production, the manufacturing tolerances to be expected from them are also not very high. They are used in widely differing environments which, for example, can be at −40 degrees C. to +75 degrees C. The force with which the screw cap is tightened also varies widely. When men are very tired and it is very cold, they have little strength to spare. It is not always important that emptying of the contents should proceed rapidly. Nevertheless, there are emergency situations in which rapid emptying of the canister is important and the ability to do this may be life-preserving. One need only consider a situation in which, for example, fuel has to be transferred from the canister to the tank on a swaying boat. If this takes too long, even a strong man cannot hold the canister balanced for long. If the transfer takes too long, there is the risk that the pouring spout will slip out of the inlet nozzle of the tank and the fuel will miss, with all the dangers that result from this, such as, for example, the risk of explosion. Frequently, it is also important to spill as little as possible, when the canister is the last spare canister, etc.

Referring to U.S. Pat. No. 4,928,861, the screw cap includes an annular channel (48) that opens away from the cap base (37), at least one through airhole (50), which leads through the cap base (37) from the annular channel (48), and an annular wall with an internal thread (34) that matches the external screw thread (18) of a pouring nozzle (16), the screw cap (32) being arranged to assume a particular angular position relative to the pouring nozzle when the screw cap is screwed fully onto the pouring nozzle.

A single through airhole 50 together with the annular channel (48) is usually sufficient. However, if this through airhole (50) is completely or partially blocked and/or if the annular channel is completely or partially closed, the air no longer flows back correctly and the abovementioned consequences can occur. For various reasons, the cross-section of the annular channel (48) can be reduced or completely closed in practice: for example enough viscous fluid may get into it at very low temperatures; or it is simply blocked; or its cross-section has been squashed shut by some other occurrence.

OBJECT AND STATEMENT OF THE INVENTION

It is the object of the invention to ensure good backflow of the air even in extreme situations.

This object is achieved by providing at least two through airholes (50, 63, 64) in the cap base, which are angularly offset relative to one another.

The described embodiment includes the following additional features:

The angular offset is between two and five airhole diameters. This feature maintains an optimum proximity between through airhole 50 and through airhole 24 and ensures that the through airholes 50 are not too close together, thus weakening the cap and possibly producing a predetermined breaking point. Furthermore, the through airholes are then sufficiently far apart so that something that causes the blockage of one of the through airholes does not also affect the other.

These advantages are further optimized when the angular offset is between two and four airhole diameters.

Three through airholes (50, 63, 64) are provided, of which, after screwing-on fully, a central one is in an alignment zone with the through hole (24) of the pouring nozzle (16) under normal conditions. By this means, there is almost always a through airhole opposite the through hole 24. The through airholes to the right and to the left of through hole 24 only come into effect in the event of extreme tolerances in one direction or the other. The internal screw thread (34) on the annular wall and the external thread (18) on the pouring nozzle are single-start threads with starts (66, 67) which, in terms of their angular position, match the through airholes (50, 63, 64).

DESCRIPTION OF THE DRAWING

The invention is now described with reference to an illustrative embodiment.

In the drawing.

DETAILED DESCRIPTION

Figure 2:
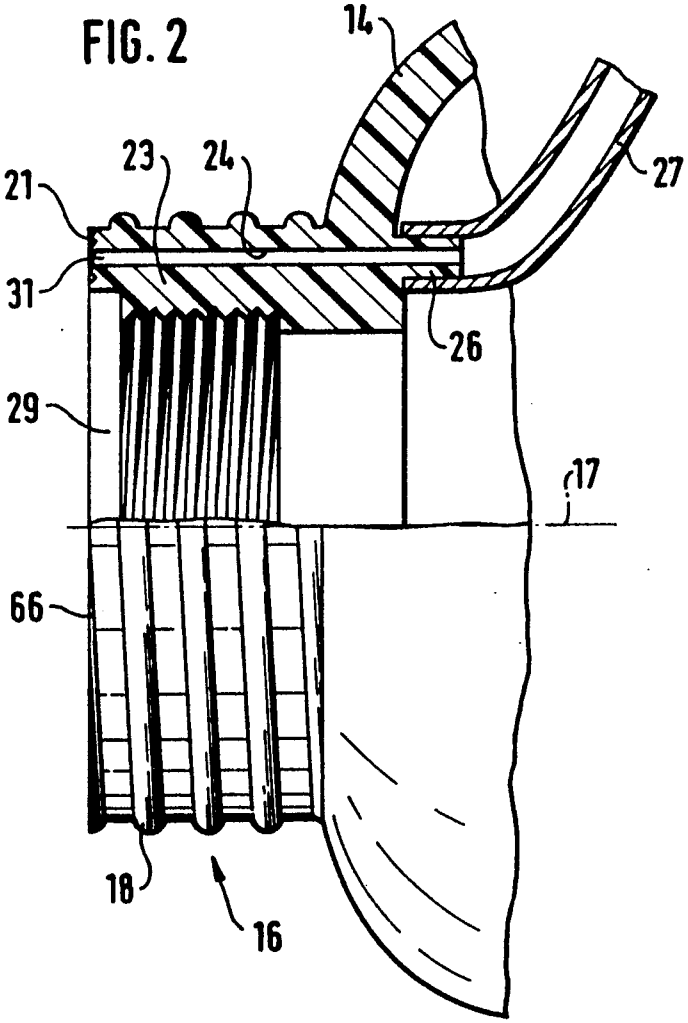
FIG. 2 shows a partially sectioned side view of the region of the pouring nozzle of a canister.
Figure 1:
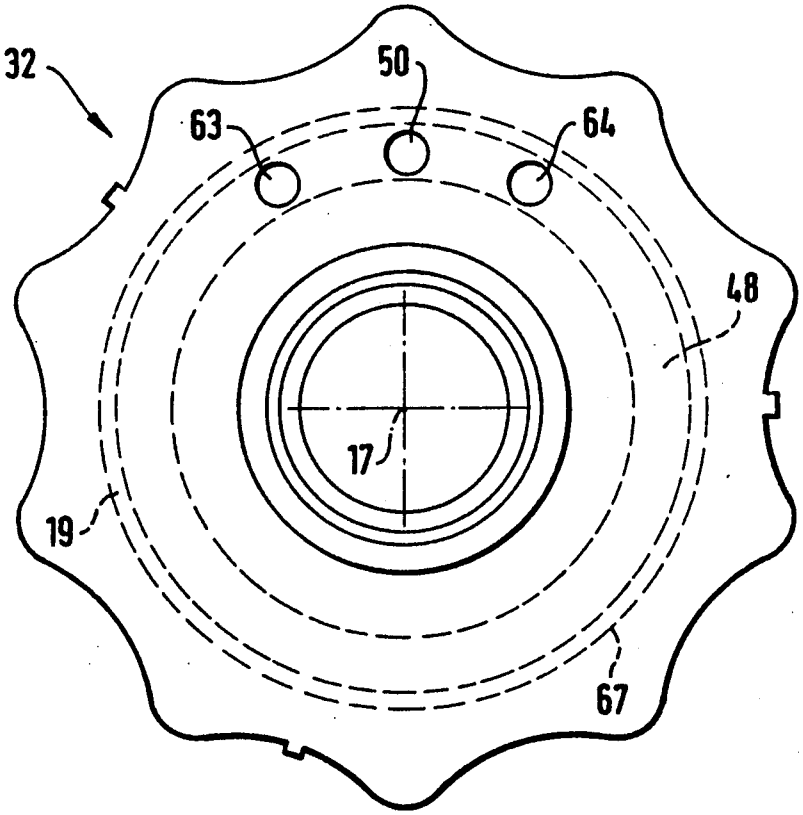
FIG. 1 shows the plan view of a screw cap without a pouring spout, otherwise however being identical to the screw cap of U.S. Pat. application Ser. No. 295,052

A canister 11, blow-molded from plastic, has a nominal volume of 20 liters. It has a pouring nozzle 16, which is essentially rotationally symmetrical to a geometrical longitudinal axis 17. The pouring nozzle bears an external screw thread 18 which is relatively coarse. In the approximately 1 cm thick wall 23 of the pouring nozzle 16 there is a through hole 24 which, during the emptying of the canister 11, is at the top, opens into the front face 21 and, on the inside of a slope 14 of the canister 11, continues in a mounting peg 26. Onto it is pushed a rigid vent tube 27, the inner end of which opens in the volume which is uppermost during the emptying of the canister. If such a canister 11 is emptied, liquid flows out of the opening 29 of the pouring nozzle 16. Air is drawn in at the opening 31 of the pouring nozzle 16, said air flowing through the through hole 24, through vent tube 27 to the far end of the latter into the uppermost air volume of the canister 11. On its lower side according to FIG. 1, a screw cap 32 has an annular channel 48 open towards the end face 21 in the use position. Into this there open through airholes 50, 63, 64. Their diameter corresponds approximately to the width of the annular channel 48. Through airholes 63, 64 have an angular spacing from airhole 50 of 30 degrees, as seen from the geometrical longitudinal axis 17. Under normal conditions, i.e. in the central range of the manufacturing tolerance, at normal temperatures and in the case of normal screw-on forces, through airhole 50 is in alignment with the opening 31. This is because an external thread 18, which is a single-start thread, has a thread start 66 which coincides with the thread start 67 of an internal thread 34. The internal thread 34 is likewise a single-start thread, with the result that the through airholes 50, 63, 64 are always in the region of the opening 31 with the screw cap 32 screwed on.

What is claimed is:

1. In a screw closure for a plastic canister, the plastic canister having a pouring nozzle that bears an external screw thread and one air venting through hole in a wall of the pouring nozzle, that opens into an end face of the pouring nozzle and leads to inside the canister, the screw closure comprising a screw closure shroud with an internal thread complementary to the external screw thread on the plastic canister and coaxial to a geometrical longitudinal axis of the screw closure, a screw closure bottom substantially perpendicular to the geometrical longitudinal axis, the screw closure bottom having a liquid outflow hole and an annular channel that is arranged coaxially and is open away from the screw closure bottom, the annular channel being defined between the screw closure bottom and the end face of the pouring nozzle and communicating with the air venting through hole, at least two and no more than three through airholes provided in the screw closure bottom which are positioned within the annular channel and angularly offset relative to one another, the angular offset being between two and five airhole diameters, and the screw closure being arranged to assume a predetermined angular position relative to the pouring nozzle when the screw closure is screwed onto the pouring nozzle fully but not overtight to position the through airholes in a symmetric manner with respect to the air venting through hole.

2. Screw cap according to claim 1, wherein three of said through airholes (50, 63, 64) are provided, of which, after screwing-on fully, a central one of said airholes is in an alignment zone with said through hole (24) of said pouring nozzle (16).

3. Screw cap according to claim 1, wherein said angular offset is between two and five airhole diameters.

4. Screw cap according to claim 3, wherein three of said through airholes (50, 63, 64) are provided, of which, after screwing-on fully, a central one of said airholes is in an alignment zone with said through hole (24) of said pouring nozzle (16).

5. Screw cap according to claim 3, wherein said angular offset is between two and four airhole diameters.

6. Screw cap according to claim 5, wherein three of said through airholes (50, 63, 64) are provided, of which, after screwing-on fully, a central one of said airholes is in an alignment zone with said through hole (24) of said pouring nozzle (16).

* * * * *